US008197670B2

(12) United States Patent
Li et al.

(10) Patent No.: US 8,197,670 B2
(45) Date of Patent: Jun. 12, 2012

(54) PROCESS FOR UPGRADING HYDROCARBONS AND DEVICE FOR USE THEREIN

(75) Inventors: Lin Li, Richmond, CA (US); Hua-Min Huang, Hercules, CA (US); Zunqing He, San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 222 days.

(21) Appl. No.: 12/711,124

(22) Filed: Feb. 23, 2010

(65) Prior Publication Data

US 2011/0203973 A1 Aug. 25, 2011

(51) Int. Cl.
*C10G 17/00* (2006.01)

(52) U.S. Cl. ..... 208/208 R; 208/251 R

(58) Field of Classification Search ..... None
See application file for complete search history.

(56) References Cited

U.S. PATENT DOCUMENTS

| | | | | |
|---|---|---|---|---|
| 4,528,100 | A | 7/1985 | Zarchy | |
| 4,559,127 | A | 12/1985 | Paspek, Jr. | |
| 4,818,370 | A | 4/1989 | Gregoli et al. | |
| 4,840,725 | A | 6/1989 | Paspek | |
| 5,096,567 | A | 3/1992 | Paspek, Jr. et al. | |
| 6,821,413 | B1 * | 11/2004 | Alkhalidl | 208/339 |
| 6,887,369 | B2 | 5/2005 | Moulton et al. | |
| 7,264,710 | B2 | 9/2007 | Hokari et al. | |
| 2003/0145984 | A1 | 8/2003 | Webre et al. | |
| 2004/0234566 | A1 | 11/2004 | Qiu et al. | |
| 2005/0040081 | A1 | 2/2005 | Takahashi et al. | |
| 2006/0102519 | A1 | 5/2006 | Tonkovich et al. | |
| 2006/0120213 | A1 | 6/2006 | Tonkovich et al. | |
| 2008/0099374 | A1 | 5/2008 | He et al. | |
| 2008/0314769 | A1 * | 12/2008 | Lenard | 206/77.1 |
| 2009/0166261 | A1 | 7/2009 | Li et al. | |
| 2009/0173664 | A1 * | 7/2009 | Choi et al. | 208/85 |
| 2009/0178952 | A1 | 7/2009 | Choi et al. | |
| 2009/0206007 | A1 | 8/2009 | Allam | |

FOREIGN PATENT DOCUMENTS

| | | |
|---|---|---|
| JP | 2000-109851 | 4/2000 |
| JP | 11-080750 | 3/2006 |
| JP | 2006-104311 | 4/2006 |
| JP | 2006-104311 A | 4/2006 |
| JP | 2007-268503 A | 10/2007 |

OTHER PUBLICATIONS

PCT International Search Report and Written Opinion, International Application No. PCT/US2011/025091, dated Sep. 30, 2011, pp. 1-5.
U.S. Appl. No. 11/966,708, filed Dec. 28, 2007, Li, et al.
U.S. Appl. No. 11/966,852, filed Dec. 28, 2007, He, et al.
U.S. Appl. No. 11/555,048, filed Oct. 31, 2006, He, et al.
U.S. Appl. No. 11/555,130, filed Oct. 31, 2006, He, et al.
U.S. Appl. No. 11/555,196, filed Oct. 31, 2006, He, et al.

(Continued)

*Primary Examiner* — Tam M Nguyen

(57) ABSTRACT

A process is disclosed using a dispersion of supercritical fluid and oil to upgrade a hydrocarbon feedstock such as a heavy oil into an upgraded hydrocarbon product or synthetic crude with highly desirable properties such as low sulfur content, low metals content, lower density (higher API), lower viscosity, lower residuum content, etc. The process utilizes a capillary mixer to form the dispersion. The process does not require external supply of hydrogen nor does it use externally supplied catalysts.

17 Claims, 3 Drawing Sheets

OTHER PUBLICATIONS

U.S. Appl. No. 11/555,211, filed Oct. 31, 2006, He, et al.
Office action received in U.S. Appl. No. 11/555,211, dated May 20, 2009.
Office action received in U.S. Appl. No. 11/966,708, dated Aug. 7, 2009.
Office action received in U.S. Appl. No. 11/555,196, dated Jul. 30, 2009.
Office action received in U.S. Appl. No. 11/555,130, dated Jun. 23, 2009.

* cited by examiner

PROCESS FOR UPGRADING HYDROCARBONS AND DEVICE FOR USE THEREIN

TECHNICAL FIELD

The disclosure relates to upgrading of hydrocarbons such as whole heavy oil, bitumen, and the like using supercritical fluid. The disclosure further relates to a device for dispersing hydrocarbons in supercritical fluid.

BACKGROUND

Oil produced from a significant number of oil reserves around the world is simply too heavy to flow under ambient conditions. This makes it challenging to bring remote, heavy oil resources closer to markets. In order to render such heavy oils flowable, one of the most common methods known in the art is to reduce the viscosity and density by mixing the heavy oil with a sufficient diluent, e.g. naphtha or any other stream with a much lower density than the heavy oil. The diluted crude oil is sent from the production wellhead via pipeline to an upgrading facility where the diluent stream is recovered and recycled back to the production wellhead in a separate pipeline, and the heavy oil is upgraded with suitable technology known in the art (coking, hydrocracking, hydrotreating, etc.) to produce higher-value products for market. Some typical characteristics of these higher-value products include: lower sulfur content, lower metals content, lower total acid number, lower residuum content, higher API gravity, and lower viscosity. Most of these desirable characteristics are achieved by reacting the heavy oil with hydrogen gas at high temperatures and pressures in the presence of a catalyst.

It is known that this diluent addition/removal process has a number of disadvantages. The infrastructure required for the handling and recovery of diluent can be expensive, especially over long distances. Hydrogen-addition processes such as hydrotreating or hydrocracking require significant investments in capital and infrastructure. Hydrogen-addition processes also have high operating costs, since hydrogen production costs are highly sensitive to natural gas prices. Some remote heavy oil reserves may not even have access to sufficient quantities of low-cost natural gas to support a hydrogen plant. These hydrogen-addition processes also generally require expensive catalysts and resource intensive catalyst handling techniques, including catalyst regeneration. In some cases, the refineries and/or upgrading facilities that are located closest to the production site may have neither the capacity nor the facilities to accept the heavy oil. Coking is often practiced at refineries or upgrading facilities. Significant amounts of by-product solid coke are rejected during the coking process, leading to lower liquid hydrocarbon yield. In addition, the liquid products from a coking plant often require further hydrotreating. Furthermore, the volume of the liquid product from the coking process is significantly less than the volume of the feed crude oil.

Processes have been proposed which have overcome these disadvantages by using supercritical water to upgrade a heavy hydrocarbon feedstock into an upgraded hydrocarbon product or synthetic crude with highly desirable properties (low sulfur content, low metals content, lower density (higher API), lower viscosity, lower residuum content, etc.). Such processes require neither external supply of hydrogen nor catalysts, nor do they produce an appreciable coke by-product. In comparison with the more traditional processes for synthetic crude production, advantages of using supercritical water include a high liquid hydrocarbon yield, no need for externally-supplied hydrogen or catalyst, significant increases in API gravity in the upgraded hydrocarbon product, significant viscosity reduction in the upgraded hydrocarbon product, and significant reduction in sulfur, metals, nitrogen, TAN, and MCR (micro-carbon residue) in the upgraded hydrocarbon product.

Despite the advances made using supercritical water to upgrade heavy hydrocarbons, difficulties remain in such a process. For instance, there remains a need to achieve sufficient dispersion of high viscosity hydrocarbons into supercritical water in order to achieve a commercially acceptable productivity level for producing synthetic crude. Under practical operating ranges of temperature and pressure, heavy oil is not totally dissolved in supercritical water. As a result, process development and reactor design must accommodate a two-phase system. It is known that supercritical water inhibits the undesired side reactions that will lead to the formation of dreg or coke by-products, and this is facilitated by good contact between water and oil. Therefore it would be desirable to further improve and optimize the process performance through enhancing water-oil mixing.

SUMMARY

One embodiment of the disclosure relates to a process for upgrading hydrocarbons comprising:

(a) mixing a hydrocarbon oil with a supercritical fluid in a capillary mixer having a capillary therethrough to form a dispersion of droplets having a ratio of oil to supercritical fluid between 10:1 and 1:5 by volume;

(b) reacting the dispersion in a reaction zone under supercritical fluid conditions for a residence time sufficient to allow upgrading reactions to occur thereby forming a reaction product; and (c) separating the reaction product into gas, effluent water, and upgraded hydrocarbon phases.

Another embodiment of the disclosure relates to a system for upgrading hydrocarbons comprising:

(a) a heater for heating a fluid to a temperature above the critical temperature of the fluid to form a supercritical fluid;

(b) a capillary mixer comprising a main tube having an inlet and an exit and having a capillary therethrough having an inner diameter between about 0.25 mm and about 2.5 mm and an injection tube which intersects the capillary at an angle between 0 and 90°;

(c) a fluid inlet for feeding the supercritical fluid from the heater to the injection tube of the capillary mixer;

(d) an oil inlet for feeding hydrocarbon oil to the inlet of the main tube of the capillary mixer;

(e) a reaction zone connectable to the exit of the main tube of the capillary mixer; and (f) a separator connectable to the reaction zone for separating a product formed in the reaction zone into gas, effluent water, and upgraded hydrocarbon phases.

DETAILED DESCRIPTION

Various aspects of heavy oil upgrading technology using supercritical water are described in commonly assigned U.S.

patent application Ser. Nos. 11/966,708, filed on Dec. 28, 2007, and 11/555,048; 11/555,130; 11/555,196; and 11/555,211, all of which were filed on Oct. 31, 2006. The present disclosure also relates to processes using supercritical fluid to upgrade hydrocarbons by using the herein disclosed technology to enhance solvent-oil mixing. The present disclosure relates to improvements of the upgrading process through improvement of dispersion of heavy oil into supercritical water.

Any hydrocarbon feed (also referred to herein as "oil") can be suitably upgraded by the present process. The process is especially suitable for heavy hydrocarbons having an API gravity (American Petroleum Institute gravity) of less than 20°. Among suitable heavy hydrocarbons are heavy crude oil, heavy hydrocarbons extracted from tar sands, commonly called tar sand bitumen, such as Athabasca tar sand bitumen obtained from Canada, heavy petroleum crude oils such as Venezuelan Orinoco heavy oil belt crudes, Boscan heavy oil, heavy hydrocarbon fractions obtained from crude petroleum oils, particularly heavy vacuum gas oils, vacuum residuum as well as petroleum tar, tar sands and coal tar. Other examples of heavy hydrocarbon feedstocks which can be used are oil shale, shale oil, and asphaltenes.

Figure 1:
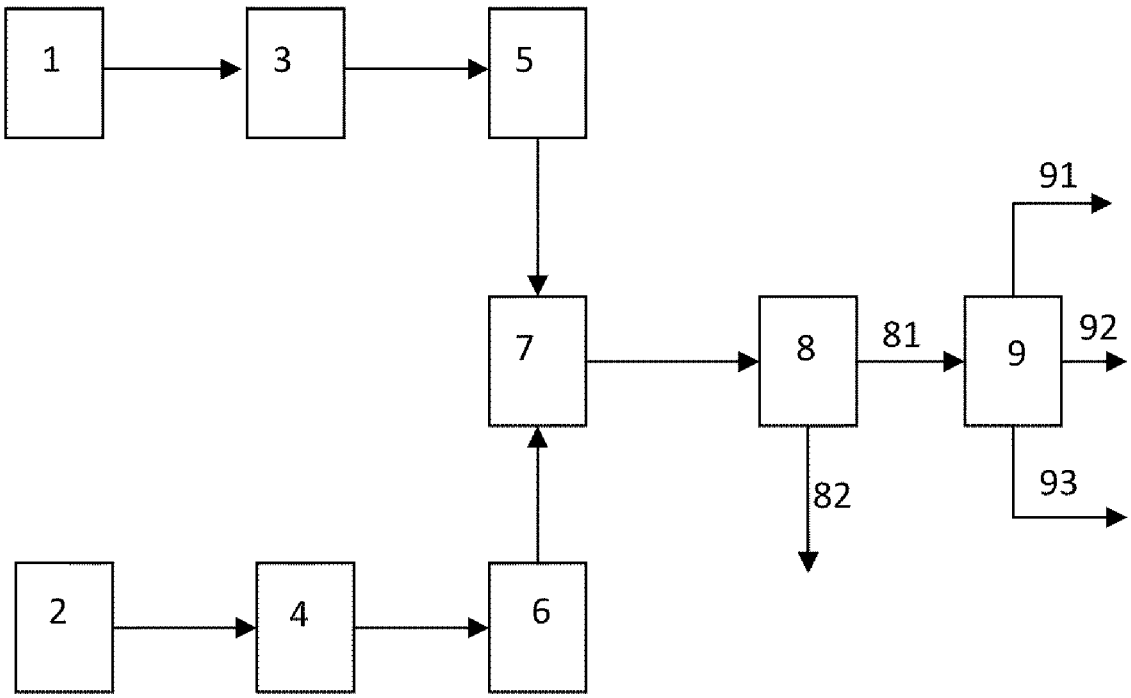
FIG. 1 is a process flow diagram of an embodiment of the present process.

A heavy hydrocarbon feed and the supercritical fluid are contacted in a capillary mixer to form a dispersion prior to entering the reaction zone. The feed oil forms a fine spray of small droplets at the capillary tip. The oil then gradually dissolves in the supercritical fluid. Depending on the solubility limit of the particular feed, the heavy oil may not totally dissolve to form a single phase. The solubility limit is affected by oil properties such as API gravity and asphaltene content. Some oils are advantageously totally dissolved in the supercritical fluid, which eventually form a single phase. Even for oils that can be totally dissolved in the supercritical fluid, a better dispersion at the mixer will facilitate the dissolution process. FIG. 1 illustrates one embodiment of the present process. Water from water storage tank 1 is delivered by a water pump 3 to water heater 5 where it is heated to supercritical temperature to form a supercritical fluid. Heavy hydrocarbon oil from oil tank 2 is delivered by an oil pump 4 to optional oil heater 6. The supercritical fluid and oil are delivered to a capillary mixer 7 where an oil-in-water dispersion is formed. In one embodiment, the dispersion has a volume ratio of oil to water from 10:1 to 1:5.

Depending on the viscosity of the feed oil, it may be necessary to preheat the oil so that the oil viscosity inside the capillary is much lower than its value at ambient conditions and the oil is flowable; otherwise an unacceptably high pressure drop may exist. Lower oil viscosity also helps to improve mixing as smaller droplet sizes will be formed. The temperature needed to achieved reasonable pressure drop and good mixing depends on the properties of the crude to be processed and therefore needs to be carefully selected. For some heavy crude with relative low viscosity, temperatures slightly higher than room temperature may be enough to achieve the mixing performance needed. For other crude with very high viscosity, much higher temperatures may be needed. The feed oil can be preheated to between 80 and 400° C., depending on the viscosity of feed oil.

After the reactants have been mixed to form a dispersion, they are passed into a reaction zone 8 in which they are allowed to react under temperature and pressure conditions of supercritical water, i.e. supercritical water conditions, in the absence of externally added hydrogen, for a residence time sufficient to initiate upgrading reactions. The temperature required for the upgrading reactions is provided by the supercritical fluid. The reaction preferably occurs in the absence of externally added catalysts or promoters, although the use of such catalysts and promoters is permissible in accordance with the present invention.

The reaction zone 8 comprises a dip-tube reactor, which is equipped with a means for collecting the reaction products (e.g., synthetic crude, water, and gases), and a bottom section where any metals or solids may accumulate and be removed as a "dreg stream" 82.

Supercritical water conditions include a temperature from the critical temperature of water, i.e., 374° C., up to 1000° C., preferably from 374° C. to 600° C. and most preferably from 374° C. to 400° C., and a pressure from the critical pressure of water, i.e., 3,205 psia (22.1 MPa), up to 10,000 psia (68.9 MPa), preferably from 3,205 psia to 7,200 psia (49.6 MPa) and most preferably from 3,205 to 4,000 psia (27.6 MPa).

The reactants react under these conditions for a sufficient time to allow upgrading reactions to occur. Preferably, the residence time will be selected to allow the upgrading reactions to occur selectively and to the fullest extent without having undesirable side reactions such as coking or residue formation. Reactor residence times may be from 1 minute to 6 hours, preferably from 8 minutes to 2 hours and most preferably from 10 to 40 minutes.

After the reaction has progressed sufficiently, a single phase reaction product 81 is withdrawn from the reaction zone, cooled, and separated into gas 91, effluent water 93, and upgraded hydrocarbon phases 92. This separation is preferably done by cooling the stream and using one or more high-pressure separators 9. These may be two-phase separators, three-phase separators, or other gas-oil-water separation device known in the art. However, any method of separation can be used in accordance with the invention.

The composition of gaseous product obtained by treatment of the heavy hydrocarbons in accordance with the process of the present invention will depend on feed properties and typically comprises light hydrocarbons, water vapor, acid gases (e.g., $CO_2$ and $H_2S$), methane and hydrogen. The effluent water 93 may be used, reused or discarded. It may be recycled to the water tank 1, the feed water treatment system or to the reaction zone 8.

The upgraded hydrocarbon product 92, which is sometimes referred to as "synthetic crude" herein may be upgraded further or processed into other hydrocarbon products using methods that are known in the hydrocarbon processing art.

The process of the present process may be carried out as a continuous, semi-continuous or batch process. In the continuous process the entire system operates with a feed stream of oil and a separate feed stream of water and reaches a steady state, whereby all the flow rates, temperatures, pressures, and composition of the inlet, outlet, and recycle streams do not vary appreciably with time.

While not wishing to be bound to any theory of operation, it is believed that one or more of a number of upgrading reactions are occurring simultaneously at the supercritical reaction conditions used in the present process. The major chemical/upgrading reactions are believed to include thermal cracking, steam reforming, water gas shift, demetalization and desulfurization.

The exact pathway may depend on the reactor operating conditions (e.g., temperature, pressure, oil/water ratio), reactor design and the hydrocarbon feedstock.

Figure 2:
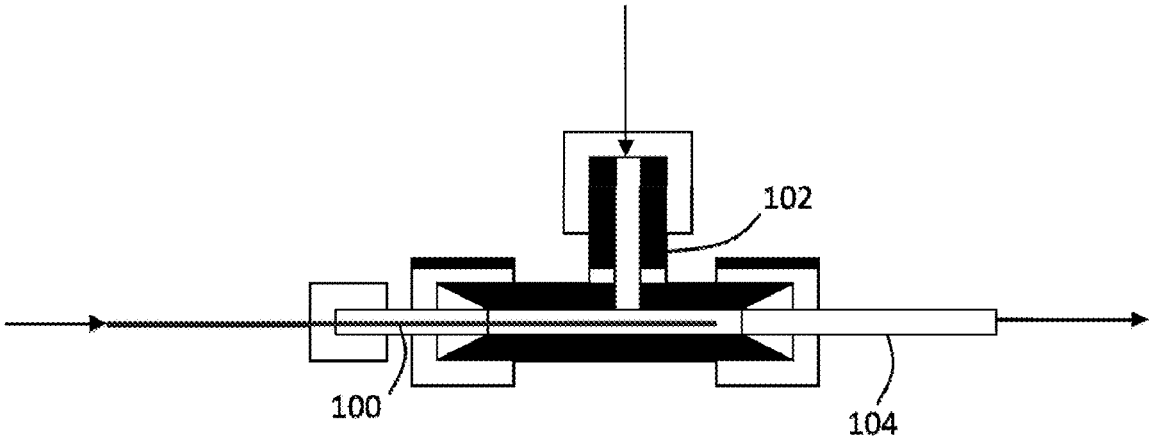
FIG. 2 is a cross-sectional view of a mixing device for use in the present process.

FIG. 2 illustrates the design of the capillary mixer 7. It has been found that with proper design of the mixer, superior mixing can be achieved to disperse oil into supercritical fluid without significant pressure drop. It is necessary to maintain high velocity within the capillary mixer to reduce the oil droplet size and thereby enhance oil dispersion and improve mass transfer. Smaller capillary size will lead to higher oil velocity to form smaller droplet size and hence enhance dispersion of oil into supercritical water phase. High velocity within the mixer also prevents potential plugging of the mixer. The inner diameter of the capillary 100 within the mixer is between about 0.01 inch (0.25 mm) and about 0.1 inch (2.5 mm). The capillary 100 is located within a main tube 104, and the supercritical fluid is injected into the main tube through injection tube 102. The injection tube can intersect the main tube at an angle between 0° (such that the supercritical fluid is injected in the same direction as the flow of the oil) and 90° (such that the supercritical fluid is injected perpendicular to the flow of the oil).

It is advantageous to minimize the residence time of oil inside the high temperature zone of the mixer, in order to avoid cracking and coking reactions. The superficial velocity of the oil inside the capillary is between 1 and 500 cm/s, even between 20 and 100 cm/s. The velocity of the supercritical water in the tube surrounding the capillary is between 1 and 50 cm/s. The Reynolds number of the oil within the capillary is from 10 to 1000, even from 20 to 400. The Reynolds number in the outside tube is from 200 to 7000, even 3000.

Since the capillary is surrounded by supercritical fluid, the feed oil inside the capillary is heated by heat transfer through the capillary wall. Such heating may be sufficient to reduce oil viscosity and therefore reduce pressure drop in the capillary and facilitate oil disperse into supercritical fluid, so that separate oil pre-heating is not necessary.

Surrounding the capillary, the supercritical fluid flows in the same direction as the oil to facilitate the oil spray at the capillary tip.

According to one embodiment of the process, the hydrocarbon feed is delivered to multiple capillary mixers in parallel. Depending on the feedstock, the specific capillary mixer design and the capacity requirements, many capillary mixers can be utilized simultaneously. For instance, 100 capillary mixers or more can be used in parallel, even 1000 capillary mixers or more.

The following Examples are illustrative of the present invention, but are not intended to limit the invention in any way beyond what is contained in the claims which follow.

EXAMPLES

Test Methods

API gravity was measured according to ASTM test method D4052-91 using a digital density meter.

Acid number was determined according to ASTM test method D664, Acid Number of Petroleum Products.

Micro Carbon Residue was determined according to ASTM test method ASTM D4530-85, and the result is reported as MCRT, wt %.

Metals content in the feed was determined by inductively coupled plasma atomic emission spectrometry (ICP-AES).

Viscosity was measured according to ASTM test method D445-94. The temperature of the measurements was 40° C. unless otherwise indicated. Viscosity was reported in centistokes (CST).

A series of experiments were conducted to examine effect of water oil mixing on process performance. All the tests were conducted at 3400 psig (23.4 MPa) with feed oil flow rate of 0.5 ml/min and water to oil volume ratio of 3.

FIG. 1 shows a process flow diagram for heavy oil upgrading using supercritical water. To examine the effect of water-oil mixing on process performance, different types of mixers were used in the experiments.

ISCO syringe pumps were used for water and feed oil. Pump head and feed line to the mixer were heated to 80 to 150° C. to reduce the viscosity.

The water was heated to supercritical temperature (400° C.) in a water heater, and then met the liquid feed oil in the mixer. The water-oil mixture then was fed to the annular space of the reactor, and flowed downward in the annular area inside the reactor. Dreg, either heavy component not initially dissolved in the supercritical water or formed during the reaction, accumulated at the reactor bottom and was removed. Product dissolved in the supercritical water then flowed upward through the dip tube to leave the reactor and was conveyed to high pressure separators. The system pressure was controlled by a back pressure regulator. The gas flow rate was measured by a wet test meter. The gas composition was analyzed using a gas sampling bomb and off-line gas chromatograph.

The unit, as shown in FIG. 1, was heated to an operating temperature in the range of 380 to 425° C. and then water was pumped into the system to bring the system up to operating pressure. When the temperature and pressure were stabilized, feed oil pumping began. The high-pressure separator (HPS) was pressurized using argon so that there was no pressure upset when it was opened to the reactor outlet to collect samples.

In the HPS, vapor phase water and oil condensed into liquid water and oil. In FIG. 1 only one HPS is shown, although multiple HPS in parallel could be used to collect product samples for a selected period of time. For most of the experimental runs, the first two hours were considered as system lineout period, and product collected during this period was not used for analysis. Typical hydrocarbon product sample from this two hour starting up period was very light because it is formed primarily through extraction. After this 2 hour start up period the reactor outlet was directed to another HPS to collect samples under steady state conditions. After each sampling period, water and oil were drained from the HPS bottom. At the end of each run, the reactor was kept at reaction temperature and pressure and flashed with water for another 2 hours to remove all hydrocarbons from the reactor.

Any dreg formed during operation was removed from the reactor bottom every two hours. During the dreg removal, the reactor pressure was decreased about 100 psig (0.69 MPa), but the pressure remained above water critical pressure, approximately 3205 psig (22.1 MPa).

Table 1 gives the run conditions, and the feed properties of Hamaca Crude and Hamaca DCO (Diluted Crude Oil) are give in Table 6. As shown in Table 1, different types of mixers were used. For Runs 1-5, an inline mixer plus 20 ft (6.1 m) coil were used. A 0.25 inch (0.63 cm) outer diameter Swagelok Tee Type particulate filter with pore size of 230 micrometers was used as the inline mixer to promote oil-water mixing. The water at supercritical conditions (400° C.) met the liquid feed oil in the inline mixer. After the mixer the water-oil stream then flowed through a 20 ft (6.1 m) spiral coil immersed in high temperature in a sand bath (same as reactor temperature) to further improve water-oil contact. For Runs 6-8, after mixing in the inline mixer the water-oil dispersion was sent to the reactor without flowing through the coil.

For Runs 9-12, a capillary mixer was used to mix the oil and supercritical water. The design of the mixer is shown in FIG. 2. The capillary mixer was constructed using a ¼" (0.63 cm) Swagelok tee, and a 1/16" (0.19 cm) outer diameter capillary with inner diameter of 0.01" (0.2 mm) or 0.032" (0.8 mm) was used to inject liquid feed oil into supercritical water stream. The feed oil was heated to 130° C. before entering the capillary. The capillary inside the tee was surrounded by supercritical water, such that the feed oil was further heated in the capillary to approximately 400° C. Due to the small oil flow rate and relatively high surface area of the capillary, it is estimated that at the capillary tip the oil temperature was very close to 400° C. Due to the high temperature, the oil viscosity was much lower than at room temperature. Thus even using extra heavy oil feed with API as low as 2.4, no significant pressure drop was observed across the capillary (less than 1 psi). At the capillary tip, high-temperature oil was injected into supercritical water to achieve a high degree of mixing.

TABLE 1

Run conditions and reactor configuration

| Run # | Feed | Mixer | Mixer Temperature ° C. | Reactor Temperature ° C. |
|---|---|---|---|---|
| 1 | DCO | Inline mixer plus | 425 | 425 |
| 2 | HAMACA | 20', ¼" coil | 380 | 400 |
| 3 | HAMACA | | 380 | 400 |
| 4 | HAMACA | | 380 | 400 |
| 5 | HAMACA | | 400 | 400 |
| 6 | HAMACA | Inline mixer, | 410 | 400 |
| 7 | HAMACA | no coil | 400 | 400 |
| 8 | HAMACA | | 385 | 400 |
| 9 | HAMACA | 0.032" capillary | 400 | 380 |
| 10 | HAMACA | | 400 | 400 |
| 11 | HAMACA | 0.01" capillary | 400 | 400 |
| 12 | DCO | | 400 | 400 |

Table 2 gives the results from these runs. For runs using the capillary mixer the Reynolds numbers inside the capillary are also listed in the table. It should be noted for a small scale lab unit, the Reynolds numbers are relatively small. In a commercial unit, it is expected that the Reynolds number will be much higher. The oil feed for Run 1 is Hamaca DCO (Diluted Crude Oil), and an inline mixer was used to mix the feed oil and supercritical water. After the inline mixer the water-oil stream flowed through a 20 ft (6.1 m) spiral coil immersed in high temperature in a sand bath (same as reactor temperature) to further improve water-oil contact. The liquid yield was found to be 62%. A significant amount of solid was accumulated in the preheating coil and also in the transfer line between preheating coil and the reactor.

TABLE 2

Experimental results of heavy oil upgrading

| Run # | Feed | Mixer | Solid in coil | Product yield | Reynolds number inside capillary |
|---|---|---|---|---|---|
| 1 | DCO | Inline mixer plus | 17.7 | 62% | |
| 2 | HAMACA | 20', ¼" coil | 7.16 | 61% | |
| 3 | HAMACA | | 7.81 | 59% | |
| 4 | HAMACA | | 7.15 | 58% | |
| 5 | HAMACA | | 4.19 | 57% | |
| 6 | HAMACA | inline mixer, | — | 56% | |
| 7 | HAMACA | no coil | — | 53% | |
| 8 | HAMACA | | — | 55% | |
| 9 | HAMACA | 0.032 capillary | — | 67% | 13 |
| 10 | HAMACA | | — | 67% | 13 |
| 11 | HAMACA | 0.01" capillary | | 68% | 42 |
| 12 | DCO | | — | 75% | 42 |

Runs 2-5 used Hamaca whole crude (API=8) as feed using the same process equipment described above. Interestingly, for whole Hamaca crude the solid deposition in the preheating coil was less than those from Hamaca DCO runs. However, the liquid yield was slightly lower.

In Runs 6-8 no preheating coil was used, and the liquid yield was about 55%.

Runs 9-11 used a capillary mixer for Hamaca crude. Compared with results using an inline mixer (Runs 6-8) we see a significant improvement in liquid yield (from 55% to 67%). In addition, with capillary mixing, no solid is accumulated in the reactor, mixer or transfer line between the mixer and the reactor. This is very advantageous since the equipment can be operated continuously without shutting down for cleaning.

The performance of capillary mixing for Hamaca DCO (Run 12) showed the same trend. Liquid yield increased from about 62% to about 75%.

The experimental results demonstrate that the use of the capillary mixer led to higher liquid yield and no solid accumulation in the reactor system.

Table 3 and 4 give the properties of the upgraded liquid product. By comparing data in these two tables we can see for both Hamaca and Hamaca DCO the product quality is basically equivalent, indicating that by using the capillary mixer, liquid yield is enhanced while maintaining product quality. It should be noted that by eliminating the pre-heating coil, the total residence time can also be decreased.

TABLE 3

Quality of liquid product using inline mixer

| Run # | Feed | Viscosity CST | API | Ni, ppm | V, ppm | S, ppm | Acid no. mg/g | MCRT wt % |
|---|---|---|---|---|---|---|---|---|
| 1 | Hamaca DCO | 9.82 | 23.4 | 6.4 | 42.6 | 27040 | 2.41 | 1.9 |
| 4 | Hamaca | 14.08 | 19.9 | 6.1 | 42.4 | 34820 | 2.26 | 2.77 |

TABLE 4

Quality of liquid product using capillary mixer

| Run # | Feed | Viscosity CST | API | Ni, ppm | V, ppm | S, ppm | Acid no. mg/g | MCRT wt % |
|---|---|---|---|---|---|---|---|---|
| 12 | Hamaca DCO | 6.34 | 24.6 | 5.5 | 39.2 | 31370 | 1.76 | 2.22 |
| 9 | Hamaca | 13.96 | 20.5 | 5.77 | 36.4 | 34310 | 2.66 | 1.98 |

Figure 3:
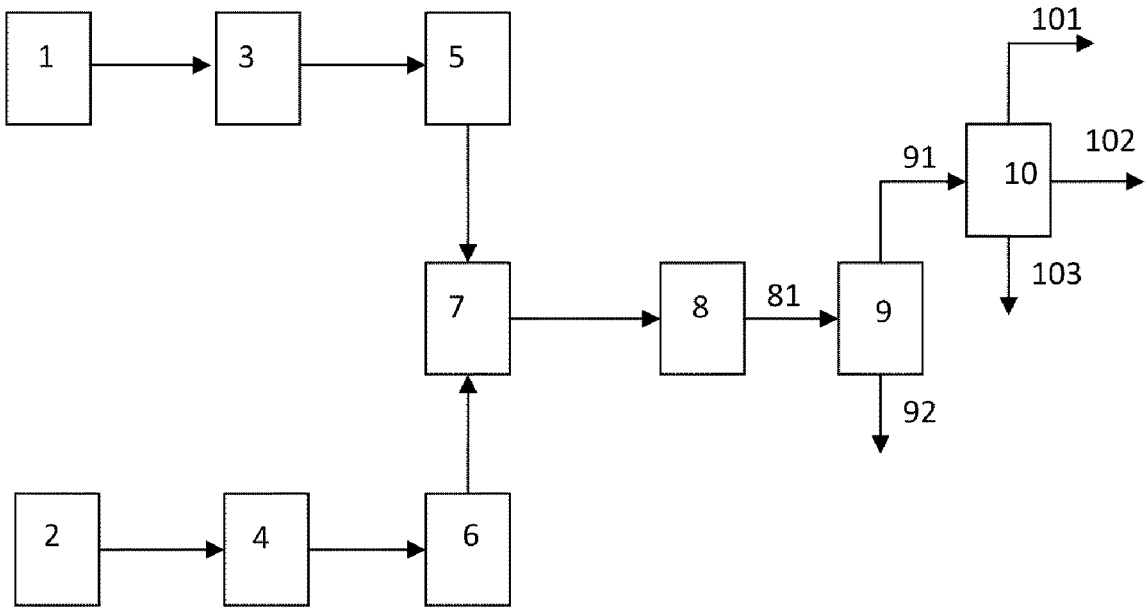
FIG. 3 is a process flow diagram of another embodiment of the present process.

The application of capillary mixing has been shown to improve the performance of heavy oil dispersion into supercritical fluid in a heavy oil upgrading process. In addition to Hamaca and Hamaca DCO, the capillary mixer was also used for upgrading of other feeds. Table 5 gives liquid yield data. An upflow reactor was used for these runs, and the process flow diagram is shown in FIG. 3. The oil and supercritical water was mixed in the capillary mixer 7, and sent to the bottom of the upflow reactor 8. After the reaction all the products left the reactor from the top and then flowed into a dreg separator 9. The dreg separator was kept at the same temperature as the reactor. The product and supercritical water flowed upward and left the dreg separator at top (stream 91) and entered into the HPS 10, while dreg was settled to the bottom. All the runs shown in Table 5 were performed at 400° C. reactor temperature. Table 6 gives properties of these feeds. The experimental results surprisingly show that a small diameter capillary mixing device is effective for dispersing heavy oil having API as low as 2 and viscosity as high as tens of thousands centipoise into supercritical water without significant pressure drop. The application of capillary mixing leads to more than 20% increase of liquid yield as compared with the prior known system. In addition, the improved mixing reduces solid formation within the reactor system, which is critical for long term commercial operation.

TABLE 5

Experimental results of heavy oil upgrading using capillary mixer

| Run # | Feed | Water/oil ratio | Mixer | Liquid yield |
|---|---|---|---|---|
| 13 | HDM | 2 | 0.032" capillary | 65% |
| 14 | HDM | 3 | 0.032" capillary | 67% |
| 15 | McKay | 2 | 0.032" capillary | 59% |
| 16 | McKay VR | 3 | 0.032" capillary | 50% |
| 17 | McKay VGO | 2 | 0.032" capillary | 91% |

TABLE 6

Feed properties

| Feed | API, ° | Viscosity, CST | MCRT, wt % | Acid no., mg/g | Ni, ppm | V, ppm | S, ppm |
|---|---|---|---|---|---|---|---|
| HDM | 14 | 219.2 | 10.23 | 2.69 | 60.8 | 157.6 | 40420 |
| McKay Crude | 8 | | 13 | 3.75 | 80.2 | 244.8 | 50000 |
| McKay VR | 2.4 | 33744 at 100° C. | 23.34 | 1.95 | 125 | 339 | |
| McKay VGO | 14.9 | 155.1 | 0.18 | 4.94 | <1 | <1 | 3.145 |
| Hamaca | 8 | 65689 | 15.8 | 5.8 | 103.5 | 434.9 | 41740 |
| Hamaca DCO | 13 | 1300 | 13 | 3 | 86 | 370 | 35000 |

There are numerous variations on the present invention which are possible in light of the teachings and supporting examples described herein. It is therefore understood that within the scope of the following claims, the invention may be practiced otherwise than as specifically described or exemplified herein.

What is claimed is:

1. A process for upgrading hydrocarbons comprising:

(a) mixing a hydrocarbon oil with a supercritical fluid in a capillary mixer having a capillary therethrough to form a dispersion of droplets of hydrocarbon oil in the supercritical fluid at a ratio of oil to supercritical fluid between 10:1 and 1:5 by volume, wherein the dispersion is formed outside the capillary;

(b) reacting the dispersion in a reaction zone under supercritical fluid conditions for a residence time sufficient to allow upgrading reactions to occur thereby forming a reaction product; and (c) separating the reaction product into gas, effluent water, and upgraded hydrocarbon phases.

2. The process according to claim 1 wherein the upgraded hydrocarbon phase of the product has an API gravity of at least 8° higher than the API gravity of the hydrocarbon oil.

3. The process according to claim 1 wherein the hydrocarbon oil has an API gravity of less than about 20°.

4. The process according to claim 1, further comprising heating the hydrocarbon oil to a temperature between about 80° C. and about 400° C. prior to step (a).

5. The process according to claim 1, wherein the hydrocarbon oil comprises hydrocarbons selected from the group consisting of whole heavy petroleum crude oil, tar sand bitumen, heavy hydrocarbon fractions obtained from crude petroleum oils, heavy vacuum gas oils, vacuum residuum, petroleum tar, coal tar and their mixtures.

6. The process according to claim 1, wherein the supercritical fluid comprises supercritical water at a temperature between about 374° C. and about 1000° C.

7. The process according to claim 1, wherein the dispersion in the reaction zone is reacted in the absence of any externally supplied catalyst or promoter.

8. The process according to claim 1, wherein the dispersion in the reaction zone is reacted in the absence of externally added hydrogen.

9. The process according to claim 1, wherein the dispersion has a residence time of between about 1 minute and about 6 hours in the reaction zone.

10. The process according to claim 1, wherein the oil within the capillary mixer has a superficial velocity of between about 1 and about 500 cm/s.

11. The process according to claim 1, wherein the capillary has an inner diameter between about 0.25 mm and about 2.5 mm.

12. The process according to claim 1, wherein the oil within the capillary has a Reynolds number of between about 10 and about 1000.

13. The process according to claim 1, wherein the capillary mixer comprises a capillary located within a main tube.

14. The process according to claim 13, wherein the supercritical fluid is injected into the capillary mixer through an injection tube intersecting the main tube at an angle between 0° and 90°.

15. The process according to claim 13, wherein the hydrocarbon oil is injected into the capillary located within the main tube and wherein the hydrocarbon oil forms a fine spray of droplets at a tip of the capillary.

16. The process according to claim 15, wherein the hydrocarbon oil forms a fine spray of droplets at a tip of the capillary and gradually dissolves in the supercritical fluid outside the capillary.

17. The process according to claim 1, wherein the separation of the reaction product into gas, effluent water, and upgraded hydrocarbon phases is done using one or more high pressure separators.

* * * * *